US005996620A

United States Patent [19]

Bensley

[11] Patent Number: 5,996,620

[45] Date of Patent: Dec. 7, 1999

[54] LIQUID DISPENSER AND CONTROL SYSTEM

[75] Inventor: Douglas S. Bensley, Springfield, Vt.

[73] Assignee: Mallinckrodt Inc., St. Louis, Mo.

[21] Appl. No.: 09/055,962

[22] Filed: Apr. 7, 1998

[51] Int. Cl.[6] ..... B67D 3/00

[52] U.S. Cl. ..... 137/554; 137/565.37; 137/588; 222/66; 222/185.1

[58] Field of Search ..... 137/554, 588, 137/565.37, 565.18; 222/66, 185.1

[56] References Cited

U.S. PATENT DOCUMENTS

| | | | |
|---|---|---|---|
| 755,556 | 3/1904 | Wilfong, Jr. | 137/565.37 |
| 2,056,863 | 10/1936 | Napier | 222/185.1 |
| 3,322,957 | 5/1967 | Scoggin | 222/66 |
| 3,814,293 | 6/1974 | Daves | 222/185.1 |
| 5,386,927 | 2/1995 | Janssen | 222/66 |
| 5,405,058 | 4/1995 | Kalis et al. | 222/185.1 |

*Primary Examiner*—A. Michael Chambers
*Attorney, Agent, or Firm*—Rothwell, Figg, Ernst & Kurz, p.c.

[57] ABSTRACT

A liquid dispenser and control system includes a base member having an intake cavity with an axis for orientation in an upward direction, the intake cavity being sealingly mateable with a mouth opening of a replaceable liquid container which, when mated with the intake cavity, is in an inverted position for draining liquid through the mouth opening into the intake cavity. The intake cavity includes a sump into which liquid from the container can drain by gravity. The vent tube assembly has an intake end connectable to atmosphere or a source of gas, the vent tube assembly extending from the base member through the intake cavity, and has a venting end for positioning inside the container. A passageway extends through a portion of the base member, the passageway having an entry end and an exit end, the entry end connected to the sump, through which liquid from the sump can drain into the passageway. A sensor has a fluid path therethrough connected to the exit end of the passageway, the sensor for detecting when liquid flow through the passageway from the container ceases and is followed by gas from the container entering the sensor. A liquid conduit is connected to the fluid path of the sensor, for receiving liquid passing through the sensor.

13 Claims, 5 Drawing Sheets

LIQUID DISPENSER AND CONTROL SYSTEM

BACKGROUND OF THE INVENTION

1. Field of the Invention

This invention relates to the field of precision liquid dispensing, such as when it is desirable or required to account by unit volume for all liquid dispensed. One such application is the dispensing of controlled substances in a clinical environment.

2. Description of the Background Art

Currently, controlled substance dispensing systems draw liquid directly from a bottle in which the material is supplied by the manufacturer. This is accomplished by intaking liquid through a dip tube that has been inserted through the bottle opening or cap with the bottle standing upright or fixtured at a slight angle. As dosages are dispensed, the material is drawn from the bottle until the level drops below the intake of the dip tube at which time air is suctioned into the dispensing system, the pumping device loses it's prime and dispensing ceases. At this point a partial dose has been dispensed and it, along with the residual liquid left in the bottle, must be accounted for. Weighing these leftover amounts, and covering the weight to the proper unit/volume using the material's specific gravity, is required.

After accounting for the partial dose and the residual liquid left in the bottle, the empty bottle must be replaced with a new full one. Because the pumping device has lost it's liquid prime after emptying the previous bottle, it is necessary to prime the system with the liquid from this new bottle. In doing so a certain amount of the liquid from this new bottle will be expelled from the dispense nozzle and must be collected, weighed and accounted for as previously described.

The shortfalls of the aforementioned system is the awkwardness of collecting, weighing and accurately accounting for the liquid lost to the partial dose and the residual liquid left in the bottle that cannot be fully drained, as well as the need to prime the system after each bottle change. Additionally, it should be understood that this is an entirely manual system and the reliance on human operation in material handling, weighing and data collection interjects many opportunities for inaccuracy and error.

There remains a need in the art for improvements in liquid dispensing and control systems.

SUMMARY OF THE INVENTION

In accordance with the present invention, a liquid dispenser and control system, comprises a base member having an intake cavity with an axis for orientation in an upward direction. The intake cavity is sealingly mateable with a mouth opening of a replaceable liquid container which, when mated with said intake cavity, said liquid container is in an inverted position for draining liquid through said mouth opening into said intake cavity. The intake cavity includes a sump into which liquid from said container can drain by gravity. Also included is a vent tube assembly having an intake end connectable to atmosphere or a source of gas, the vent tube assembly extending from said base member through said intake cavity, and having a venting end for positioning inside said container. A passageway extends through a portion of said base member, the passageway having an entry end and an exit end, the entry end connected to said sump, through which liquid from said sump can drain into said passageway. A sensor having a fluid path therethrough is connected to the exit end of said passageway, said sensor for detecting when liquid flow through said passageway from said container ceases and is followed by gas from said container entering said sensor. A liquid conduit is connected to said fluid path of said sensor, for receiving liquid passing through said sensor.

DETAILED DESCRIPTION OF THE PREFERRED EMBODIMENT

The present invention is useful for dispensing controlled substances, such as liquid methadone, in a clinical environment.

Figure 1:
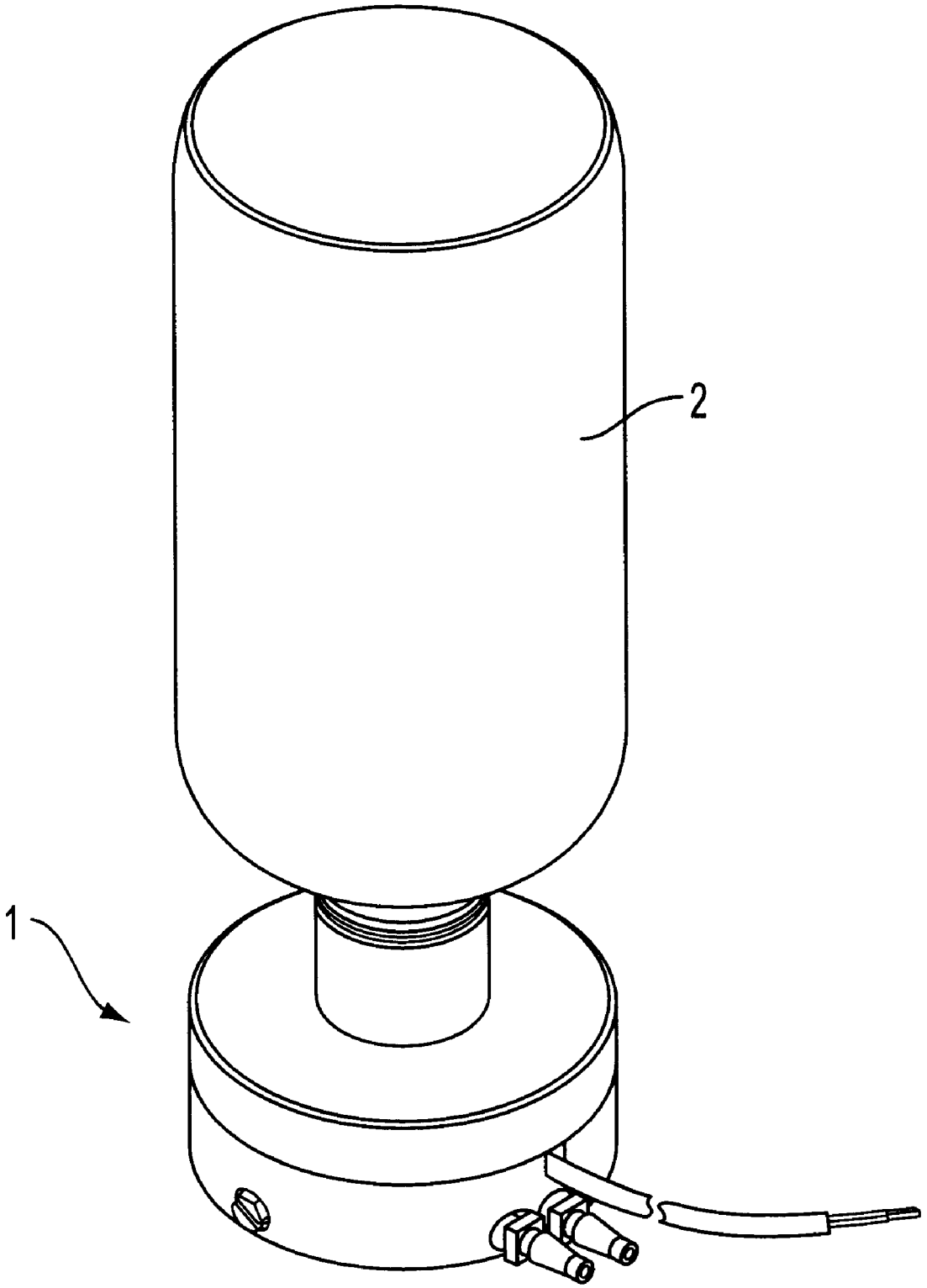
FIG. 1 is a perspective view of a liquid dispenser and control system in accordance with one embodiment of the invention.

With reference to FIG. 1, a liquid dispenser and control system in accordance with the present invention includes a base member 1.

Figure 2:
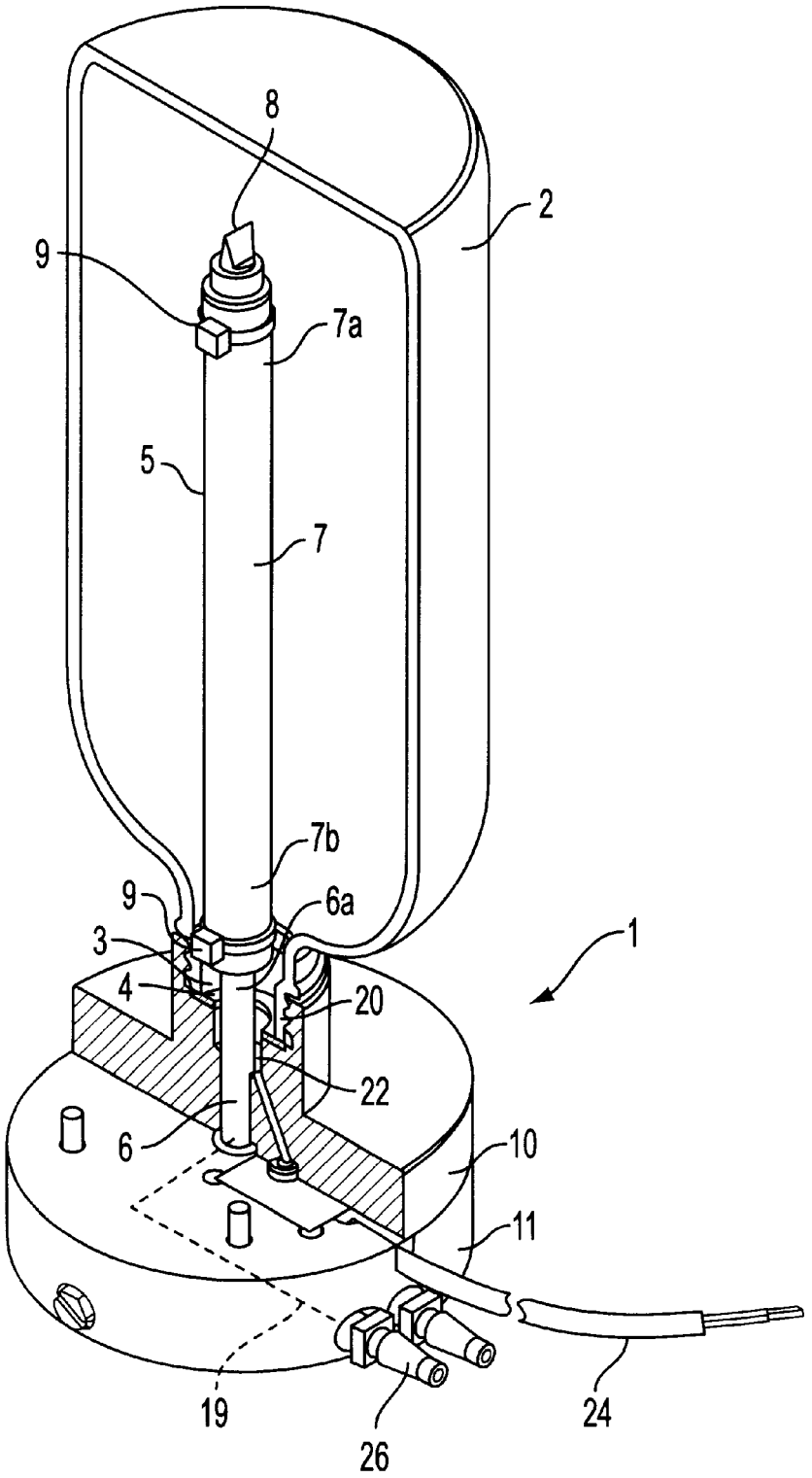
FIG. 2 is a perspective view, partially sectional with portions broken away, showing details internal to the device of FIG. 1.

As shown in FIG. 2, base member 1 includes an intake cavity with a vertical axis for orientation in an upward direction.

The intake cavity 3 is sealingly mateable with a mouth opening 20 of a replaceable liquid container such as bottle 2.

As shown in FIGS. 1 and 2, when the replaceable liquid container 2 is mated with intake cavity 3, the liquid container 2 is an inverted position for draining liquid from the container 2 through said mouth opening 20 into intake cavity 3.

In preferred embodiments, base member 1 is not fixedly mounted to any surface or structure, allowing it to be reoriented and attached with bottle 2 in an upright vertical position, and then inverted.

In the embodiment shown, a washer 4 provides a liquid-tight seal between the opening of bottle 2 and intake cavity 3.

It can also be seen in FIG. 2 that container 2 has a threaded mouth opening 20 for sealingly mating engagement with corresponding threads of the intake cavity 3.

With further reference to FIG. 2, the intake cavity 3 includes a sump 22 into which liquid from the container can drain by gravity.

A vent tube assembly 5 is provided, extending from base member 1 through the intake cavity 3. In preferred embodiments, a check valve 8 is provided at a venting end of vent tube assembly 5 for positioning inside container 2. Check valve 8 provides for one-way flow of gas out of the vent tube assembly 5 and prevents liquid from entering the vent tube assembly 5.

Vent tube assembly 5 allows air or other gas to enter the container 2 to replace liquid that is drawn from it through base member 2. Check valve 8 prevents liquid flow into the vent tube assembly 5.

In the embodiments shown, the vent tube assembly 5 extends substantially coaxially through sump 22.

Figure 4:
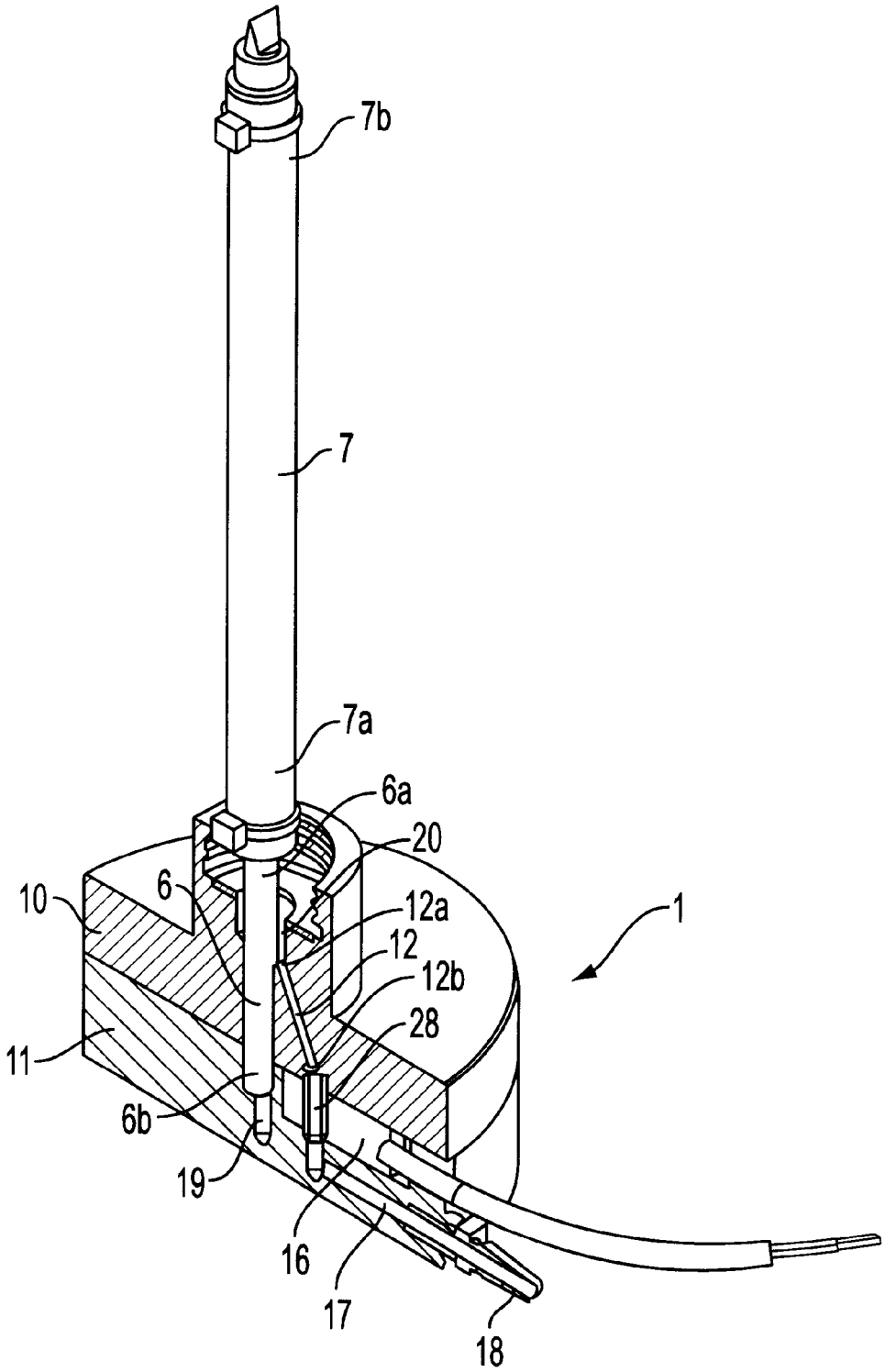
FIG. 4 is a perspective view, partially sectional with portions broken away, showing details of the device of FIG. 2.

In preferred embodiments, the vent tube assembly 5 is comprised of a stand tube portion 6 having upper and lower ends 6*a* and 6*b* respectively, shown in FIG. 4. In the embodiment shown, stand tube 6 is substantially rigid. The lower end 6*b* of stand tube 6 is connected to a gas conduit 19 in base member 1, which gas conduit 19 is connectable to atmosphere or a source of gas.

FIG. 2 shows in phantom lines the gas conduit 19 in base member 1, which connects the lower end of the stand tube portion 6 to atmosphere or a source of gas. In the embodiment shown, the connection is by means of a gas tube fitting 26.

The vent tube assembly 5 further includes a compliant tube portion 7, having upper and lower ends 7*a* and 7*b* respectively.

In the embodiment shown in FIG. 2, tubing clamps 9 are used to attach the upper end 6*a* of stand tube portion 6 to the lower end 7*b* of compliant tube portion 7, as well as attach the check valve 8 to the upper end 7*a* of compliant tube portion 7.

In the embodiment shown, base member 1 comprises an upper base portion 10 and a lower base portion 11. See FIG. 3. The upper and lower base portions 10 and 11 are held together by any suitable means, such as screws (not shown). The upper base portion 10 includes the intake cavity 3, as well as a passageway 12 which extends through the upper portion 10 of base member 1. Passageway 12 has an entry end 12*a* and an exit end 12*b*. The entry end 12*a* is connected to the sump 22, through which liquid from sump 22 can drain into passageway 12 from container 2.

Figure 3:
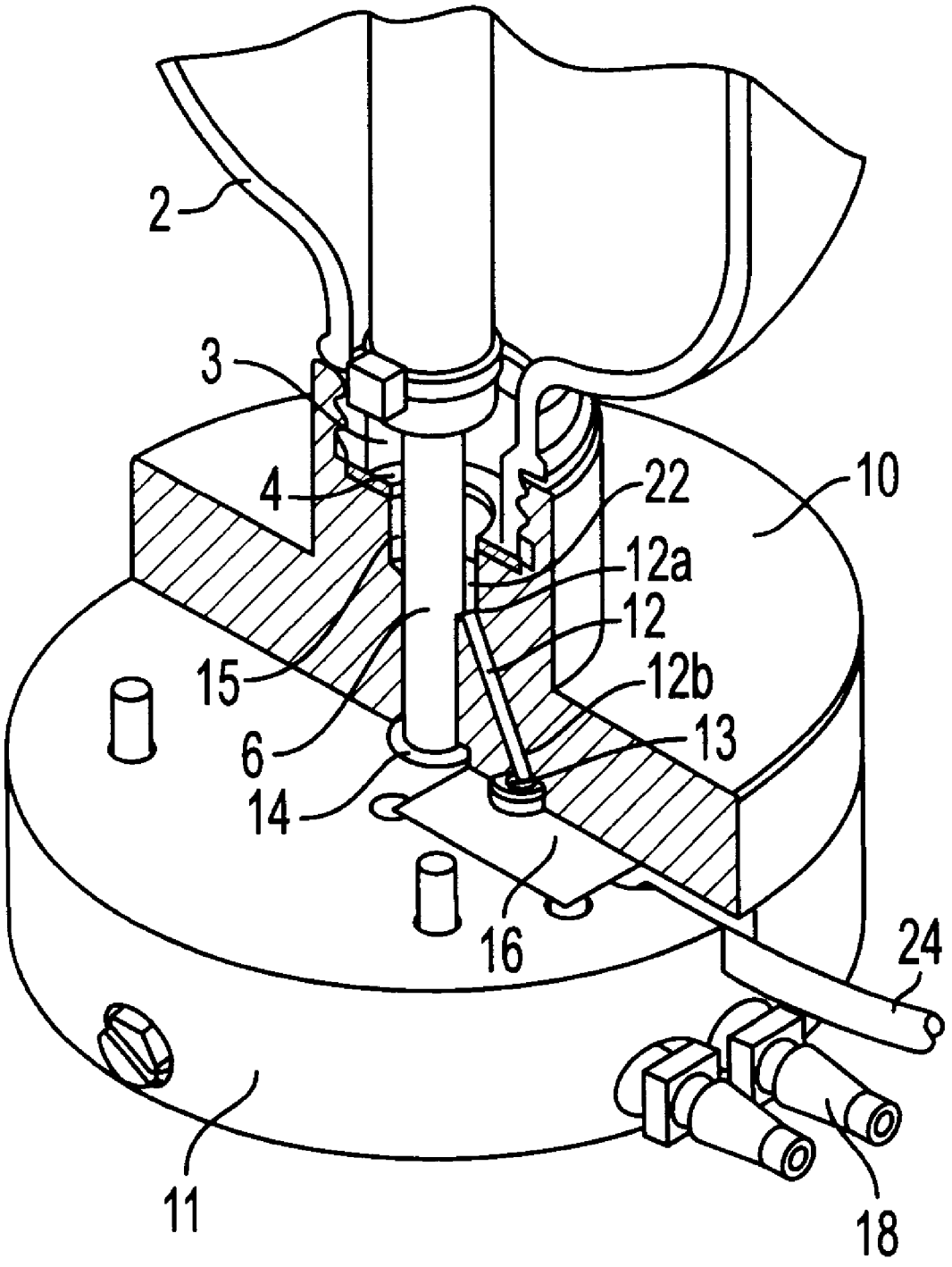
FIG. 3 is an enlarged perspective view, partially sectional with portions broken away, similar to FIG. 2.

With reference to FIGS. 3 and 4, a sensor 16 is provided having a fluid path 28 therethrough connected to the exit end 12*b* of passageway 12.

Sensor 16 detects when liquid flow through passageway 12 from container 2 ceases and is followed by air or gas from the container entering the sensor through passageway 12. Sensor 16 can be an optical device, or any other suitable flow-through type device for sensing a change from liquid flow to gas. In the embodiment shown, the sensor has a vertical sight tube which is comprised of fluid path 28.

In preferred embodiments, passageway 12 is at a positive angle with respect to the axis of intake cavity 3, more preferably at an angle between about 5° and about 45°, even more preferably at an angle of between 20° and about 30°, and in the embodiment shown, at an angle of about 25.7°.

As shown in FIGS. 2, 3 and 4, the lower base member 11 includes sensor 16 mounted therein. As shown clearly in FIG. 4, the stand tube 6 extends from the lower base portion 11 through the upper base portion 10.

The lower base portion 11 further includes liquid conduit 17 for directing liquid to a liquid dispenser, which may be connectable to a liquid tube fitting 18.

FIG. 4 also shows a portion of gas conduit 19. As shown in FIG. 2, gas conduit 19 is connected to gas tube fitting 26.

Figure 5:
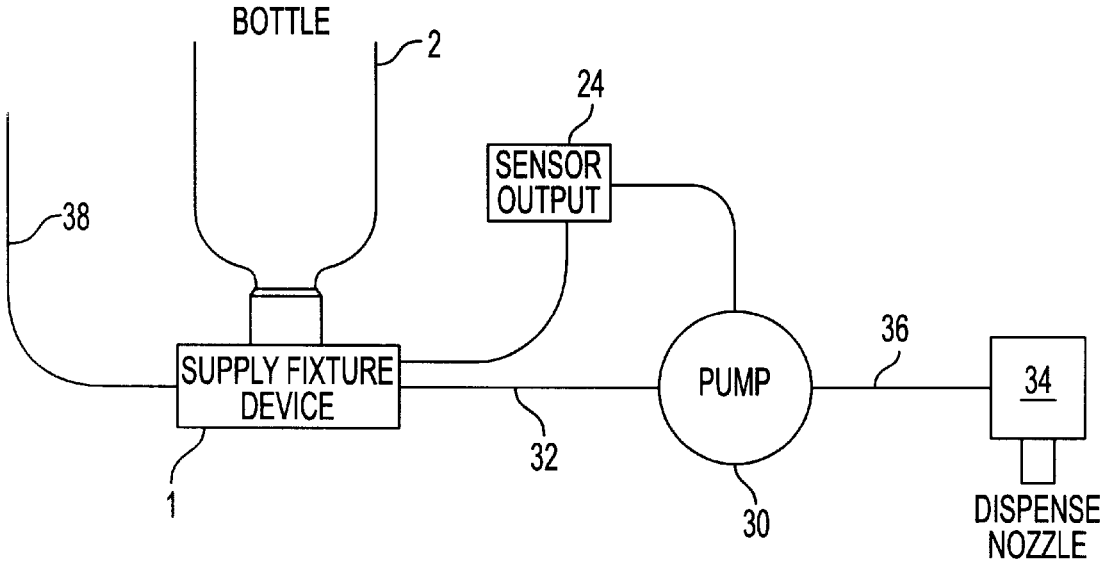
FIG. 5 is a primarily schematic drawing of a dispensing system according to one embodiment, to which the present invention is applicable.

Sensor 16 includes a sensor output 24, which is connected to a pump 30 for shutting pump 30 off when air is detected in fluid path 28 by sensor 16. Pump 30 is connected to liquid tube fitting 18 by line 32 shown in FIG. 5. Pump 30 also is connected to dispense nozzle 34 by line 36, for dispensing the liquid material. Also shown in FIG. 5 is a vent line 38 which is connected to the gas tube fitting 26 shown in FIG. 2. Line 38 can be connected to atmosphere, or to a source of gas.

The top portion 10 of base member 1 includes cavities for holding washer seal 4, as well as seals 13 and 14 shown in FIG. 3.

The present invention provides a device which allows a container such as bottle 2 to be completely drained of its contents and provide a signal output to stop dispensing of the liquid before air is introduced into pump 30 and the pump looses its prime. The device of the present invention permits the contents of each bottle to be accounted for discretely.

The present invention also provides, through automatic sensing, for monitoring the amount of liquid dispensed into a partial dose at the time of shut-down. This eliminates the need for an operator to weigh and account for this partial dose as the system will be able to complete the prescribed dose after the empty bottle has been replaced with a full one.

The present invention thus greatly improves the traditional method of dispensing controlled liquid substances by providing improved material handling capabilities and an automatic liquid sensing feature to offer automatic monitoring and control of the liquid volumes used.

Since many modifications, variations and changes in detail may be made to the described embodiment, it is intended that all matter in the foregoing description and shown in the accompanying drawings be interpreted as illustrative and not in a limiting sense.

I claim:

1. A liquid dispenser and control system, comprising:

a base member having an intake cavity with an axis for orientation in an upward direction, the intake cavity being sealingly mateable with a mouth opening of a replaceable liquid container which, when mated with said intake cavity, said liquid container is in an inverted position for draining liquid through said mouth opening into said intake cavity;

said intake cavity including a sump into which liquid from said container can drain by gravity;

a vent tube assembly having an intake end connectable to atmosphere or a source of gas, the vent tube assembly extending from said base member through said intake cavity, and having a venting end for positioning inside said container;

a passageway extending through a portion of said base member, the passageway having an entry end and an exit end, the entry end connected to said sump, through which liquid from said sump can drain into said passageway;

a sensor having a fluid path therethrough connected to the exit end of said passageway, said sensor for detecting when liquid flow through said passageway from said container ceases and is followed by gas from said container entering said sensor;

a liquid conduit connected to said fluid path of said sensor, for receiving liquid passing through said sensor.

2. The system of claim 1, wherein said container is a bottle having a threaded mouth opening, and wherein said intake cavity has mating threads for sealingly mating with said mouth opening.

3. The system of claim 1, wherein said venting end of said vent tube assembly includes a check valve for one-way flow of gas out said vent tube assembly, and preventing liquid from entering said vent tube assembly.

4. The system of claim 3 wherein said vent tube assembly comprises a stand tube portion having upper and lower ends, the lower end connected to a gas conduit in said base member, which gas conduit is connectable to said atmosphere or said source of gas, the upper end of the stand tube portion connected to a lower end of a compliant tube portion of said vent tube assembly, the compliant tube portion having an upper end connected to said check valve.

5. The system of claim 4 wherein said stand tube is substantially rigid.

6. The system of claim 5 wherein said base member comprises upper and lower base portions, the upper base portion including said intake cavity and said passageway, the lower base portion including said sensor mounted therein and said stand tube extending from said lower base portion through said upper base portion, said lower base portion further including said liquid conduit for directing liquid to a liquid dispenser, said lower base portion further comprising said gas conduit.

7. The system of claim 6 wherein said passageway is at a positive angle with respect to said axis of said intake cavity.

8. The system of claim 7 wherein said angle is between about 5° and about 45°.

9. The system of claim 8 wherein said angle is between about 20° and about 30°.

10. The system of claim 6 wherein said lower base member further comprises a liquid tube fitting connected to said liquid conduit in a gas tube fitting connected to said gas conduit.

11. The system of claim 10, wherein said liquid tube fitting is connected to a pump, which pump is further connected to a dispense nozzle for dispensing said liquid.

12. The system of claim 1 wherein said vent tube assembly extends through said sump.

13. The system of claim 12 wherein said vent tube assembly extends substantially coaxially through said sump.

* * * * *